United States Patent [19]

Moulet

[11] Patent Number: 4,632,796

[45] Date of Patent: Dec. 30, 1986

[54] METHOD OF MANUFACTURING A SANDWICH WALL PANEL BY MOLDING

[75] Inventor: Jean M. M. Moulet, Verdun, France

[73] Assignee: Groupement pour l'Industrialisation du Batiment "G.I.B.A.T.", Verdun, France

[21] Appl. No.: 816,423

[22] Filed: Jan. 6, 1986

[51] Int. Cl.[4] ..... B28B 1/16

[52] U.S. Cl. ..... 264/253; 52/426; 52/565; 264/251; 264/256

[58] Field of Search ..... 264/71, 253, 256, 251, 264/DIG. 57; 52/426, 561, 565

[56] References Cited

U.S. PATENT DOCUMENTS 2,457,982 1/1949 Deichmann ..... 264/253

4,206,163 6/1980 Decoster ..... 264/71 X

*Primary Examiner*—Jan H. Silbaugh

*Attorney, Agent, or Firm*—Christel, Bean & Linihan

[57] ABSTRACT

A method for manufacturing a sandwich wall panel by molding, formed from an inner bearing wall portion, an outer freely expandable wall and an insulating insert sheet, the wall portions being joined together by means of one of more elongate connecting elements and being held at a distance from each other by means of one or more rigid spacers interposed between the walls. Rigid spacers (11) are positioned at the bottom of a horizontal mold which have two opposite faces (12, 13) parallel to the bottom of the mold, as well as a slanting face (17) joining said opposite faces (12, 13) together and turned outwardly of the mold, each spacer (11) being held away from the bottom of the mold at a distance substantially equal to the thickness of the inner wall portion (15) by means of a support (27), the slanting faces (17) of the spacers (11) being all oriented in the same direction. Each connecting element (20) is disposed so that it rests on the slanting face (17) of a spacer, relative positioning elements between the connecting elements (20) and the spacer (11) being provided. The inner wall portion is cast at the bottom of the mold. On this wall portion is placed the insulating sheet in which localized recesses have been formed which are filled by the spacers (11). The outer wall portion is then cast on the insulating sheet.

4 Claims, 3 Drawing Figures

METHOD OF MANUFACTURING A SANDWICH WALL PANEL BY MOLDING

The invention relates to a method of manufacturing a sandwich wall panel, which comprises an internal bearing wall, a freely expandable outer wall and an insulating insert sheet, these walls being joined together by means of one or more elongate connection elements and being held at a distance from each other by means of one or more rigid spacers interposed between the walls. Such a wall panel, intended for the construction of buildings, comprises for example two reinforced concrete wall portions.

The invention provides a new process for prefabricating such a wall panel, by molding.

It is already known to mold a sandwich wall panel for example in a horizontal mold. Before casting the material forming the wall portions, reinforcement frames should be placed at the bottom of the mold, as well as said connection elements and said spacers.

Since each spacer must be disposed essentially between the two wall portions to be molded, it should be held at a given distance from the bottom of the mold corresponding to the thickness of the inner bearing wall molded first, without hindering the spreading of the material to be cast straight above or straight below the spacer.

Moreover, each connection element must be disposed at a given distance from the bottom of the mold but also with a given slant with respect to the plane of the mold.

In known processes, each spacer and each connection element are thus positioned by being suspended from temporary support means or from frames reinforcing the wall portions of the wall panel, this work being long and not allowing very accurate positioning of the spacer and the connection element.

To overcome this problem, the invention provides a method of manufacturing a sandwich wall panel, by molding, in which each spacer simply bears on the bottom of the mold by means of a light support, this spacer having a slanted face to which the connection element is fastened; this latter is then positioned and oriented by the spacer.

More precisely, the invention provides a method for manufacturing sandwich wall panels formed by an inner bearing wall portion, an outer freely expandable wall portion and an insulating insert sheet, said wall portions being joined together by means of one or more elongate connection elements and being held at a distance from each other by means of one or more rigid spacers interposed between said walls, characterized in that it consists in:

spacing apart at the bottom of the horizontal mold said rigid spacers which have two opposite faces parallel to the bottom of the mold, as well as a slanted face joining said opposite faces together and turned outwardly of the mold, each spacer being held away from the bottom of the mold by a distance substantially equal to the thickness of said inner wall portion by means of a support, the slanted faces of said spacers being all oriented in the same direction;

disposing each connection element so that it rests on the slanted face of a spacer, relative positioning means between said connection element and said spacer being provided:

casting said inner wall portion at the bottom of the mold;

placing said insulating sheet on this wall portion in which localized recesses have been formed which are filled by said spacers; and casting said outer wall portion on the insulating sheet.

Preferably, said spacer support comprises a plurality of rods extending between the bottom of the mold and the spacer.

Preferably, said relative positioning means between the connection element and the spacer comprise a cross bar carried by the connection element which is housed in a groove formed in the slanting face of the spacer.

In the case where said connection element is a closed metal pin, two metal bars are disposed in the mold, on each side of each spacer, before casting said wall portions, which bars extend parallel to the bottom of a mold and each of which passes through one of the ends of the pin, said metal bars being fixed to frames reinforcing said wall portions.

The invention also provides a sandwich wall panel obtained by the above method, characterized in that it comprises an inner bearing wall portion, an outer freely expandable wall portion fastened to the inner wall at one or more points, and an insulating insert sheet, said panel comprising at each of these points:

a rigid spacer which is interposed between said wall portions and which has two opposite parallel faces in contact with these walls and a slanting face joining together said opposite faces and turned upwards said outer wall, the slanting faces of the spacers being all oriented in the same direction;

an elongate connection element which passes through said insulating sheet and is fastened in said walls, and which is disposed against said slanting face of the spacer;

a support extending between the spacer and the free face of said inner wall portion; and relative positioning means between the connection element and the spacer.

Preferably, said spacer support comprises a plurality of rods.

Preferably, said relative positioning means between the connection element and the spacer comprise a cross bar carried by the connection element, which is housed in a groove formed in the slanting face of the spacer.

Advantageously, the connection element is a closed metal pin which has passing therethrough, on each side of the spacer, two metal bars which extend inside said wall portions and parallel thereto, and are fixed to reinforcing frames of said walls.

This wall panel advantageously has the following complementary characteristics:

said pin is made from stainless steel;

said metal bars are made from soft steel;

said metal bars cooperate with said pin by means of an insulating means free of chlorine;

said spacer is made from wood.

Other details and advantages of the invention will be clear from the following description of one embodiment given by way of non limitative example, with reference to the accompanying Figures in which.

Figure 1:
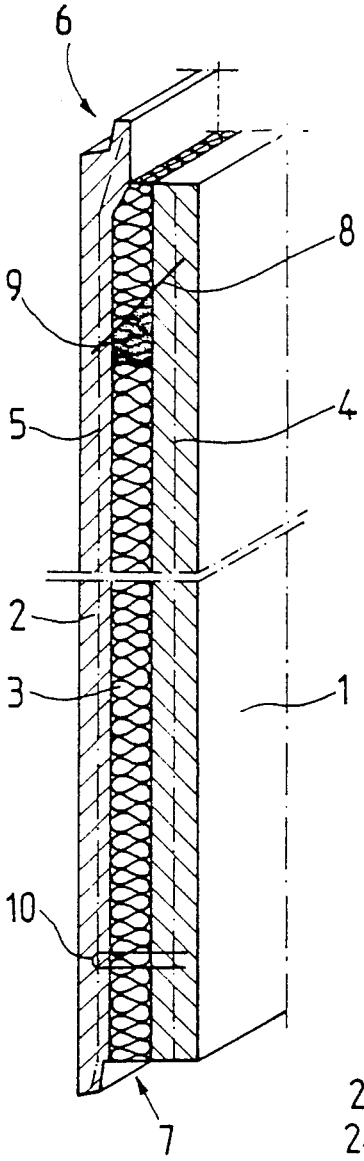
FIG. 1 is a partial perspective view of a sandwich wall panel.

FIG. 1 shows in elevation a generally rectangular shaped wall panel comprising in a way known per se an inner reinforced concrete bearing wall portion 1, an outer facing wall portion 2 also made from reinforced concrete and an insulating polystyrene sheet 3 disposed between the two preceding wall portions. Each wall portion 1, 2 comprises a soft steel frame 4, 5 embedded in the mass. The wall portions 1, 2 have appropriate upper and lower profiles 6, 7 for ensuring continuity of the wall with the panels disposed above and below and with possible floors. The inner wall portion 1 is a bearing wall and so bears rigidly on the inner wall portion disposed therebelow, while transmitting the weight of the wall portions situated above it. The outer wall portion 2, which is thinner, transmits no load but simply forms an outer ornamentation. This outer wall portion 2 is fastened at several points, in its upper part, to the inner wall portion 1 by means of a metal pin 8 connecting the two wall portions together and being engaged in each of them. Pin 8 is slanted downwards from the inner wall portion 1 towards the outer wall portion 2 and bears, in its part passing through the insulating sheet 3, on a spacer 9 having a corresponding slanting face, disposed between the two wall portions and itself resting on the inner wall portion 1. The slanting faces 17 of the different spacers 9 are all oriented in the same direction, namely turned towards the upper profile 6 of the wall portions 1, 2. Cramps 10, known per se, are disposed about the periphery of the panel, and more particularly in its lower part, for holding the two wall portions one against the other.

Figure 2:
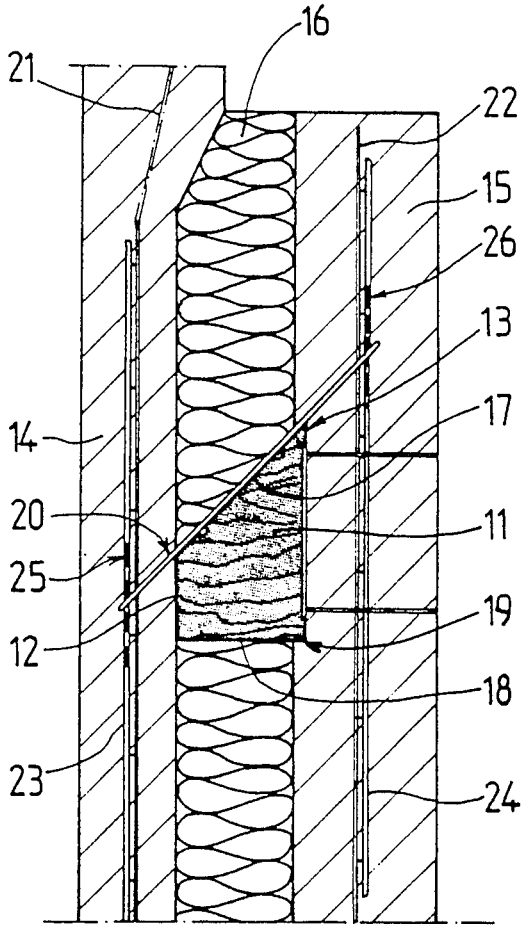
FIG. 2 is an enlarged cross section of such a panel obtained in accordance with the method of the invention.
Figure 3:
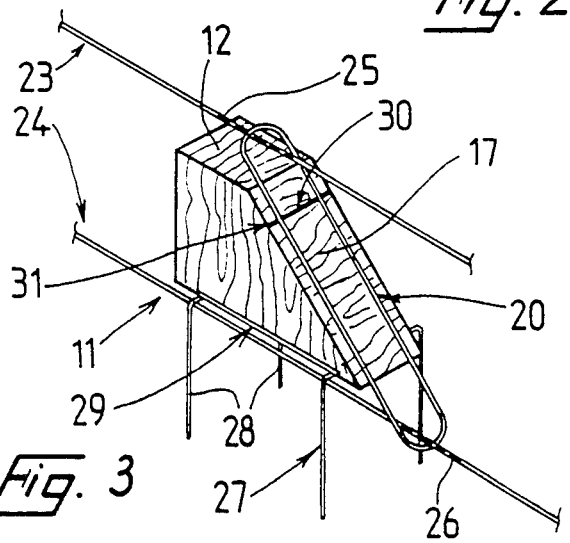
FIG. 3 is a perspective view of the means for assembling the panel of FIG. 2.

A wall panel formed in accordance with the invention is shown in elevation in FIG. 2; its assembly means such as disposed in a horizontal mold are shown in FIG. 3. This panel comprises a hard wood spacer 11, treated with a fungicide and having, in longitudinal section, the shape of a right angled trapezium and, in cross section, the form of a rectangle.

Spacer 11 has a front face 12 on which the outer wall portion 14 bears and a rear face 13 which bears on the inner wall portion 15. The front and rear faces 12, 13 are parallel, disposed opposite each other and spaced apart by a distance slightly greater than the thickness of the insulating sheet 16. Spacer 11 further has an upper face 17 joining the front and rear faces 12, 13 together, which is slanted downwardly through 45° from the rear face to the front face.

Since the width of spacer 11, between its front and rear faces 12, 13, is greater than the thickness of the insulating sheet 16, the spacer 11 projects slightly inside the inner wall portion 15 and bears by its lower face 18 on a shoulder 19 of this wall portion. Spacer 11 is oriented so that its fibers are disposed transversely to the wall portions 14 and 15. The panel also comprises a closed stainless steel pin 20 formed by bending a rod back on itself so as to form an elongate ring, and by welding the two superimposed ends of the rod together. The pin 20 is placed flat on the upper face 17 of spacer 11 and is therefore oriented following the slant of this face. The length of pin 20 is very slightly greater than the spacing existing between the planes of the two longitudinal steel frames 21, 22 embedded in the wall portions 14, 15. In order to fasten the pin 20 to each of the frames 21, 22, two soft steel bars 23, 24 are disposed vertically in the two respective wall portions 14, 15, the bars passing through the pin 20 and bearing, in their middle zone, on its two bent ends. Bars 23, 24 also take their bearing on the faces of frames 21, 22 which are not disposed opposite each other. They are of a sufficient length to provide good distribution of the forces originating at the ends of the pin. The direct contact between the soft steel bars 23, 24 and the stainless steel pin 20 is avoided by disposing a chlorine free insulator 25, 26 about the bars 23, 24 in the contact zone with pin 20. This insulator is more especially an epoxy resin or a plastic material sheath.

The method of manufacturing a wall panel shown in FIG. 2 will now be explained with reference to FIG. 3. This panel is manufactured in a horizontal mold. Before molding the inner wall portion 15 at the bottom of the mold, the conventional reinforcement 22 of wall portion 15 (not shown in FIG. 3) is disposed therein. Then the spacer supports 27 are positioned.

Each spacer support 27 comprises two U shaped staples made from rods 28, and held at a distance from each other by means of two parallel rods 29 which are spaced apart from each other by a distance equal to the thickness of spacers 11. This spacer support is more particularly made from metal or from a plastic material.

Each spacer support 27 rests on the bottom of the mold via the four vertical rods 28 of the two staples. A spacer 11 is then placed on each spacer support 27, between the two horizontal rods 29, so as to be held in position.

A cross bar 30 is welded close to one of the ends of pin 20, so as to allow positioning of this latter on the spacer 11. This bar is of the same material as pin 20. It is housed in a groove 31 of corresponding dimensions and orientation formed in the upper slanting face 17 of spacer 11, close to its front face 12. All that is then required is to pass the lower bars 24 through pins 20 and to fix them to the reinforcements 22 of the inner wall portion 15, more particularly by means of metal wires.

Then the concrete is cast corresponding to the inner wall portion 15. After vibration, on this wall portion is disposed the polystyrene insulating sheet 16 in which localized recesses have been already formed which are filled by the spacers 11. Then the reinforcements 21, not shown, of the outer wall portion 14 are positioned and the upper bars 23 are fixed thereto which pass through the pins 20. Finally the concrete of the outer wall portion 14 is cast and it is vibrated.

The above described means for assembling the panel comprise essentially a spacer and a pin. This pin may have other shapes than the one described. It may be formed by any rigid elongate piece (rods, sectional irons, metal plates), which may be fastened to the two wall portions of the wall panel. The load distributing bars, which pass through the pin, prevent the concrete from being torn away in the vicinity of the pin fastening.

It will be noted that each spacer support 27, because of its very fine design, does not hinder pouring of the concrete above and below the spacer 11, nor the filling of the corresponding space. The space support 27 may be designed differently from what has been described, to the extent that it respects this requirement.

Pin 20 may be held on the upper slanting face 17 of spacer 11 by any means other than the one described.

The invention finds its application in the manufacture of all sandwich panels comprising a freely expandable outer wall portion.

I claim:

1. A method of manufacturing a sandwich wall panel by molding, formed from an inner bearing wall portion, an outer freely expandable wall portion and an insulating insert sheet, said wall portions being joined together by means of one or more elongate connecting elements and being held at a distance from each other by means of one or more rigid spacers interposed between said wall portions, characterized in that it consists in:

positioning at the bottom of a horizontal mold said rigid spacers (11) which have two opposite faces (12, 13), parallel to the bottom of the mold, as well as a slanting face (17) joining said opposite faces (12, 13) together and turned outwardly of the mold, each spacer (11) being held away from the bottom of a mold by a distance substantially equal to the thickness of said inner wall portion (15) by means of a support (27), the slanting faces (17), of said spacers (11) all being oriented in the same direction;

disposing each connecting element (20) so that it rests on the slanting face (17) of the spacer, relative positioning means between said connecting element (20) and said spacer (11) being provided;

casting said inner wall portion (15) at the bottom of the mold;

placing on this wall portion said insulating sheet (16) in which localized recesses have been formed which are filled by said spacers (11); and casting said outer wall portion (14) on the insulating sheet (16).

2. The process according to claim 1, characterized in that said spacer support (27) comprises a plurality of rods (28) extending between the bottom of the mold and the spacer (11).

3. The process according to claim 1, characterized in that said relative positioning means between the connecting element (20) and the spacer (11) comprise a cross bar (30) carried by the connecting elements, which is housed in a groove (31) formed in the slanting face (17) of the spacer (11).

4. The process according to claim 1, characterized in that said connecting element is a closed metal pin (20) and in that, before casting said wall portions (14, 15), two metal bars (23, 24) are disposed in the mold on each side of each spacer (11), which bars extend parallel to the bottom of the mold and each pass through one of the ends of the pin (20), said metal bars (23, 24) being fixed to reinforcing frames (21, 22) of said wall portions (14, 15).

* * * * *